US007806993B2

(12) United States Patent
Miyazaki et al.

(10) Patent No.: US 7,806,993 B2
(45) **Date of Patent: *Oct. 5, 2010**

(54) HEAT-RESISTANT FERRITIC STAINLESS STEEL AND METHOD FOR PRODUCTION THEREOF

(75) Inventors: Atsushi Miyazaki, Chiyoda-ku (JP); Kenji Takao, Chiyoda-ku (JP); Osamu Furukimi, Chiyoda-ku (JP)

(73) Assignee: JFE Steel Corporation (JP)

( * ) Notice: Subject to any disclaimer, the term of this patent is extended or adjusted under 35 U.S.C. 154(b) by 389 days.

This patent is subject to a terminal disclaimer.

(21) Appl. No.: 10/512,782

(22) PCT Filed: Jun. 2, 2003

(86) PCT No.: PCT/JP03/06950

§ 371 (c)(1),
(2), (4) Date: Oct. 27, 2004

(87) PCT Pub. No.: WO03/106722

PCT Pub. Date: Dec. 24, 2003

(65) Prior Publication Data

US 2005/0211348 A1 Sep. 29, 2005

(30) Foreign Application Priority Data

Jun. 14, 2002 (JP) ..... 2002-173697
Jun. 17, 2002 (JP) ..... 2002-176209

(51) Int. Cl.
*C22C 38/22* (2006.01)
*C22C 38/48* (2006.01)
*C21D 8/04* (2006.01)

(52) U.S. Cl. ..... 148/325; 148/608; 148/653; 420/68; 420/69; 420/62

(58) Field of Classification Search ..... 420/62, 420/69, 583, 68; 148/325, 609–610, 605, 148/547, 608, 653
See application file for complete search history.

(56) References Cited

U.S. PATENT DOCUMENTS 3,617,258 A 11/1971 Terada
(Continued)

FOREIGN PATENT DOCUMENTS

EP 0 440 220 A1 8/1991
(Continued)

OTHER PUBLICATIONS

Machine-English translation of Japanese patent 2002-146484, Tetsuor Kariya et al., May 22, 2002.*

(Continued)

*Primary Examiner*—Deborah Yee
(74) *Attorney, Agent, or Firm*—DLA Piper LLP (US)

(57) ABSTRACT

The present invention provides a ferritic stainless steel that has excellent strength at high temperature, oxidation resistance at high temperature, and salt corrosion resistance at high temperature and that can be used under high temperatures exceeding 900° C., and a method of producing the same.

Specifically, the composition thereof is adjusted, on a % by mass basis, so as to include
C: 0.02% or less;
Si: 2.0% or less;
Mn: 2.0% or less;
Cr: from 12.0 to 40.0%;
Mo: from 1.0 to 5.0%;
W: more than 2.0% and 5.0% or less;
wherein the total content of Mo and W: (Mo+W)≧4.3%,
Nb: from 5 (C+N) to 1.0%,
N: 0.02% or less, and
Fe and inevitable impurities as residual.

29 Claims, 1 Drawing Sheet

U.S. PATENT DOCUMENTS 7,341,690 B2 * 3/2008 Miyazaki et al. ..... 420/69

FOREIGN PATENT DOCUMENTS

| | | | |
|---|---|---|---|
| EP | 0 449 611 | A1 | 10/1991 |
| EP | 0 530 604 | A2 | 3/1993 |
| EP | 1 087 028 | A1 | 3/2001 |
| EP | 1 207 214 | A2 | 5/2002 |
| JP | 06 136488 | | 5/1994 |
| JP | 08 188856 | | 7/1996 |
| JP | 2000-192196 | A | 7/2000 |
| JP | 2001-303202 | * | 10/2001 |
| JP | 2002-4008 | A | 1/2002 |
| JP | 2002-146484 | * | 5/2002 |

OTHER PUBLICATIONS

Machine-English translation of Korean patent 2001061570, H. Kim et al., Jul. 7, 2001.*

English abstract of Korean patent 2001061570, H. Kim et al., Jul. 7, 2001.*

* cited by examiner

HEAT-RESISTANT FERRITIC STAINLESS STEEL AND METHOD FOR PRODUCTION THEREOF

TECHNICAL FIELD

This disclosure relates to a ferritic stainless steel which has excellent strength at high temperature, oxidation resistance at high temperature, and salt corrosion resistance at high temperature, and is suitable for members used in high-temperature environments, for example, exhaust pipes of automobiles and motorcycles, outer casings for catalysts, exhaust ducts in thermal power generation plants, or fuel cells (for example, separators, interconnectors and reformers).

BACKGROUND

Exhaust system members such as exhaust manifolds, exhaust pipes, converter cases, and mufflers, used in exhaust environments of automobiles are required to have superior formability and superior heat resistance. Conventionally in many cases, Cr-containing steel sheets containing Nb and Si, for example, Type 429 (14Cr-0.9Si-0.4Nb-base) steel, which is malleable, has superior formability at room temperature, and has relatively increased high-temperature strength, have been used for the aforementioned applications.

However, when exhaust gas temperatures are increased to 900° C. to 1000° C., which is higher than can be endured, due to improvements in engine performance, there is a problem in that Type 429 steel has insufficient high-temperature proof stress or oxidation resistance.

Accordingly, a material having strength higher than that of Type 429 steel at 900° C. and having superior oxidation resistance is required. When the high-temperature strength of the material for the exhaust system members is increased, it becomes possible to reduce the thicknesses of the members so as to advantageously contribute to reduced weight of automobile bodies.

For example, in Japanese Unexamined Patent Application Publication No. 2000-73147, a Cr-containing steel having superior high-temperature strength, formability, and surface properties is disclosed as a material which can be applied to a wide range of temperatures from the high temperature portion to the low temperature portion of the exhaust system member. This material is a Cr-containing steel containing C: 0.02 mass percent or less, Si: 0.10 mass percent or less, Cr: 3.0 to 20 mass percent, and Nb: 0.2 to 1.0 mass percent. By decreasing the Si content to 0.10 mass percent or less, precipitation of the $Fe_2Nb$ Laves phase is suppressed in order to prevent an increase in yield strength at room temperature, and to be invested superior high-temperature strength and formability, as well as excellent surface properties.

European Patent Application Publication No. EP1207214 A2 discloses that precipitation of the Laves phase is suppressed to ensure that strength at high temperature is stably increased in solid solution Mo under the conditions that satisfy C: from 0.001% to less than 0.020%, Si: more than 0.10% to less than 0.50%, Mn: less than 2.00%, P: less than 0.060%, S: less than 0.008%, Cr: 12.0% or more to less than 16.0%, Ni: 0.05 or more to less than 1.00%, N: less than 0.020%, Nb: 10×(C+N) or more to less than 1.00%, Mo: more than 0.8% to less than 3.0%; wherein Si≦1.0-0.4 Mo, and W: 0.50% or more to 5.00% or less, as required.

These two publications aim to improve the high-temperature strength at 900° C. The strength and the oxidation resistance at 900° C. are evaluated in the these art.

However, the above-mentioned material for exhaust members still have problems in terms of the oxidation resistance at high temperature, i.e., 900° C. to 1000° C.

In order to improve engine performance, a significant increase in the exhaust gas temperatures is unavoidable. When the exhaust temperature is increased to 900° C. to 1000° C., the conventional material exhibits extraordinary oxidation, or has poor high-temperature strength.

The term "extraordinary oxidation" herein refers to the phenomenon that the material becomes ragged. When the material is exposed to the high temperature exhaust gas, a Fe oxide is produced, which is extremely rapidly oxidized.

The term "salt corrosion at high temperature" herein means that the sheet thickness becomes thinner due to corrosion. The corrosion occurs when salts in an antifreezing agent applied on road surfaces in cold regions, or salts in seawater near shores become attached to the exhaust pipes and then are heated at high temperature. It could therefore be advantageous to provide a ferritic Stainless steel which has excellent strength at high temperature, oxidation resistance at high temperature, and salt corrosion resistance at high temperature.

SUMMARY

We discovered that the addition of W, and especially Mo and W, efficiently improves the oxidation resistance at high temperature and the high-temperature strength.

Also, we discovered that the addition of Si or Al efficiently improve the salt corrosion resistance at high temperature.

Thus, our steels include:

1. A ferritic stainless steel having a composition, on a % by mass basis, comprises:
   C: 0.02% or less;
   Si: 2.0% or less;
   Mn: 2.0% or less;
   Cr: from 12.0 to 40.0%;
   Mo: from 1.0 to 5.0%;
   W: more than 2.0% and 5.0% or less;
   wherein the total content of Mo and W: (Mo+W)≧4.3%,
   Nb: from 5 (C+N) to 1.0%,
   N: 0.02% or less, and
   Fe and inevitable impurities as residual.

2. The ferritic stainless steel according to the above 1, wherein the content of Si is from 0.5 to 2.0%, and the content of Cr is from 12.0 to 16.0%.

3. The ferritic stainless steel according to the above 2, further comprising, on a % by mass basis, at least one element selected from the group consisting of Ti: 0.5% or less, Zr: 0.5% or less, and V: 0.5% or less.

4. The ferritic stainless steel having excellent strength at high temperature, oxidation resistance at high temperature, and salt corrosion resistance at high temperature according to the above 2 or 3, further comprising, on a % by mass basis, at least one element selected from the group consisting of Ni: 2.0% or less, Cu: 1.0% or less, Co: 1.0% or less; and Ca: 0.01% or less.

5. The ferritic stainless steel according to any one of the above 2 to 4, further comprising, on a % by mass basis, Al: from 0.01 to 7.0%.

6. The ferritic stainless steel according to any one of the above 2 to 5, further comprising, on a % by mass basis, at least one element selected from the group consisting of B: 0.01% or less, and Mg: 0.01% or less.

7. The ferritic stainless steel according to any one of the above 2 to 6, further comprising, on a % by mass basis, REM: 0.1% or less.

8. The ferritic stainless steel according to the above 1, wherein the content of Cr is more than 16.0% and 40.0% or less.

9. The ferritic stainless steel according to the above 8, wherein a total content of Mo and W, on a % by mass basis, that satisfies the following expression:

$$(Mo+W) \geqq 4.5\%.$$

10. The ferritic stainless steel according to any one of the above 8 to 9, further comprising, on a % by mass basis, at least one element selected from the group consisting of Ti: 0.5% or less, Zr: 0.5% or less, and V: 0.5% or less.

11. The ferritic stainless steel according to the above 8, 9 or 10, further comprising, on a % by mass basis, at least one element selected from the group consisting of Ni: 0.2% or less, Cu: 1.0% or less, Co: 1.0% or less, and Ca: 0.01% or less.

12. The ferritic stainless steel according to any one of the above 8 to 11, further comprising, on a % by mass basis, further comprising Al: from 0.01 to 7.0% or less.

13. The ferritic stainless steel according to any one of the above 8 to 12, further comprising, on a % by mass basis, at least one element selected from the group consisting of B: 0.01% or less, and Mg: 0.01% or less.

14. The ferritic stainless steel according to any one of the above 8 to 13, further comprising, on a % by mass basis, comprising REM: 0.1% or less.

15. The ferritic stainless steel sheet according to any one of the above 1 to 14, which is a hot rolled steel sheet, or a cold rolled steel sheet.

16. A method of producing a ferritic hot rolled stainless steel sheet, comprising the steps of: adjusting the composition according to the above 1 to 14 of a molten steel to provide a steel slab, hot rolling the slab, and annealing and pickling the hot rolled sheet, as required.

17. The method of producing the ferritic cold rolled stainless steel sheet according to the above 16, further comprising the steps of cold rolling, annealing and pickling the hot rolled steel sheet.

DETAILED DESCRIPTION

Figure 1:
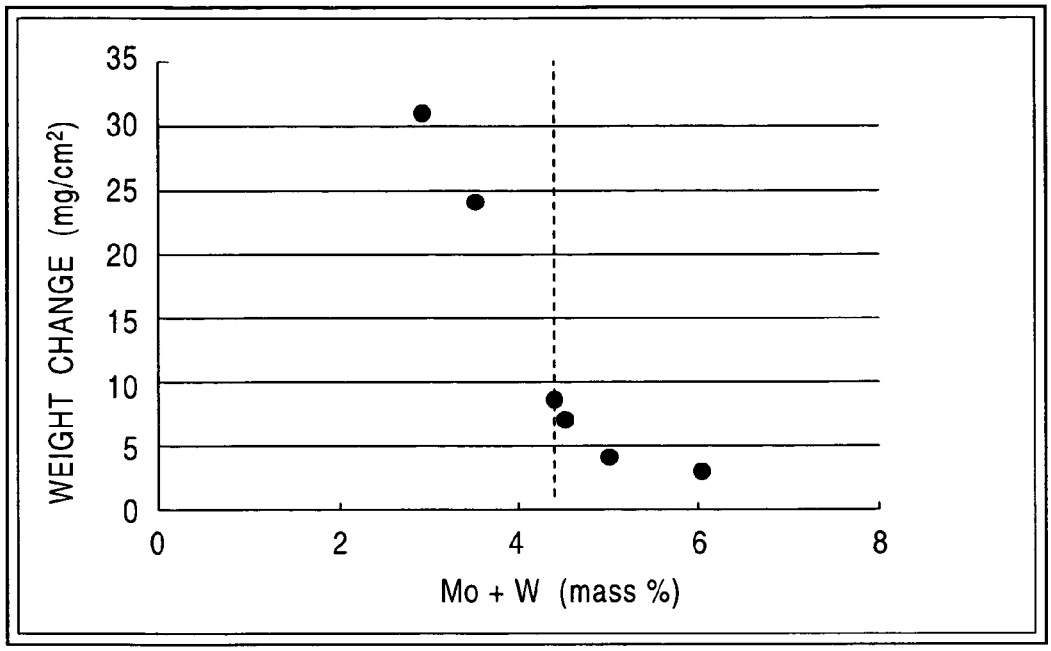
FIG. 1 is a graph showing oxidation resistance at high temperature of a steel sheet containing 14% Cr-0.8% Si-0.5% Nb into which Mo and W are added at various percentages, which is represented by Mo+W content.

The reasons for the ranges of the composition of the steel sheet will be described: All "%" symbols regarding the composition herein mean mass percent unless otherwise indicated.

C: 0.02% or Less

Since C degrades the toughness and the formability, it is preferable that the C content be as low as possible. From this viewpoint, the C content is limited to 0.02% or less. More preferably, the C content is 0.008% or less.

Cr: from 12.0 to 40.0%

Cr is an element improving the corrosion resistance and the oxidation resistance. In order to provide the effectiveness, the Cr content is 12.0% or more. In view of the corrosion resistance, the Cr content is desirably 14.0% or more. In the case where the oxidation resistance at high temperature is important, the Cr content is desirably more than 16.0%. In the case where the formability is important, the Cr content is desirably 16.0% or less.

If the Cr content exceeds 40.0%, the material becomes significantly brittle. Accordingly, the Cr content is limited to 40.0% or less, preferably 30.0% or less, and more preferably 20.0% or less.

Si: 2.0% or Less

If the Si content exceeds 2.0%, the strength at room temperature is increased, and the formability is degraded. Accordingly, the Si content is limited to 2.0% or less. If the Cr content is 16.0% or less, the salt corrosion resistance at high temperature is improved by the Si. In view of the above, the Si content is preferably 0.5% or more, and more preferably from 0.6 to 1.2%.

Mn: 2.0% or Less

Mn functions as a deoxidizing agent. However, when in excess, MnS is formed so as to degrade the corrosion resistance. Therefore, the Mn content is limited to 2.0% or less, and more preferably 1.0% or less. In view of scale adhesion resistance, a higher Mn content is preferable. The Mn content is preferably 0.3% or more.

Mo: from 1.0 to 5.0%

Mo improves not only the strength at high temperature, but also the oxidation resistance and the corrosion resistance. The Mo content is 1.0% or more. However, if the Mo content is significantly increased, the strength at room temperature is increased, and the formability is degraded. Accordingly, the Mo content is limited to 5.0% or less, and more preferably from 1.8 to 2.5%.

W: More than 2.0% to 5.0% or Less

W is an especially important element. In other words, W is combined and contained in the Mo-bearing ferritic stainless steel, thereby significantly improving the oxidation resistance at high temperature as well as the strength at high temperature. However, when the W content is less than 2.0%, the effect is not well exerted. On the other hand, if the W content exceeds 5.0%, the cost is unfavorably increased. Therefore, the W content is more than 2.0%, but 5.0% or less. When the W content exceeds 2.6%, the strength at high temperature is significantly improved. It is preferably more than 2.6%, but 4.0%.or less, and more preferably from 3.0% to 3.5%.

$$(Mo+W) \geqq 4.3\%$$

Mo and W are combined and contained to significantly improve the oxidation resistance at high temperature, as described below. The total content of these elements is preferably 4.3% or more, more preferably 4.5% or more, more preferably 4.7% or more, and more preferably 4.9% or more.

Figure 2:
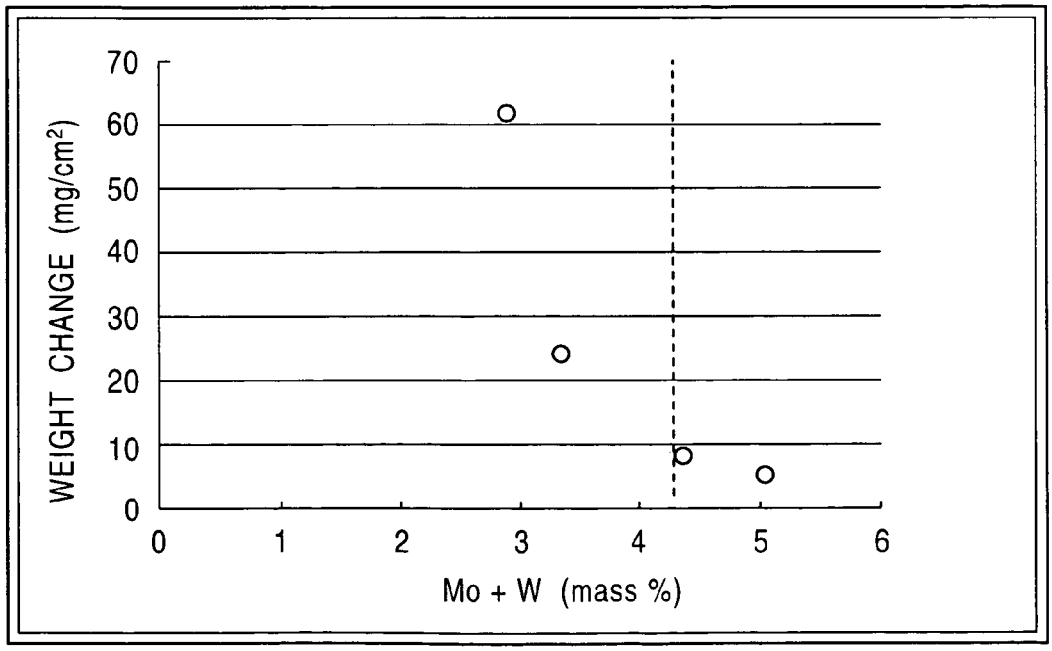
FIG. 2 is a graph showing oxidation resistance at high temperature of a steel sheet containing 18% Cr-0.1% Si-0.5% Nb into which Mo and W are added at various percentages, which is represented by Mo+W content.

FIG. 1 shows the oxidation resistance at high temperature of cold rolled and annealed steel sheets containing 14% Cr-0.8% Si-0.5% Nb into which Mo (1.42% to 1.98%) and W (1.11% to 4.11%) are added at various percentages. FIG. 2 shows the oxidation resistance at high temperature of cold rolled and annealed steel sheets containing 18% Cr-0.1% Si-0.5% Nb into which Mo (1.81% to 1.91%) and W (1.02% to 3.12%) are added at various percentages.

The oxidation resistance at high temperature was evaluated at 1050° C. for accelerating oxidation. A test piece was held at 1050° C. in air for 100 hours, and the weight change was measured after the test. The test piece with the least weight change has excellent oxidation resistance at high temperature. In other words, then the weight change after the test is 10 $mg/cm^2$ or less, the oxidation resistance at high temperature is considered excellent.

As is apparent from FIGS. 1 and 2, when the content of Mo+W is 4.3% or more, the oxidation resistance at high temperature is significantly improved. In the test for the oxidation resistance at high temperature, two test pieces each having a thickness of 2 mm, a width of 20 mm, and a length of 30 mm were taken from each cold rolled and annealed stainless sheet, and held at 1050° C. in air for 100 hours. The weight of each test piece was measured before and after the test. The weight changes of the two test pieces were calculated and averaged.

Nb: 5(C+N) to 1.0%

Nb is an element improving the strength at high temperature. The effect is exhibited when the Nb content is expressed by the formula: 5(C+N) or more, taking the C and N contents into consideration. However, if Nb is added excessively, the strength at room temperature is increased, and the formability is degraded. Therefore, the Nb content is limited to 1.0% or less, and more preferably from 0.4 to 0.7%.

N: 0.02% or Less

N is an element degrading the toughness and the formability. Accordingly, the N content is reduced as much as possible. Therefore, the N content is limited to 0.02% or less, and more preferably 0.008% or less.

The basic components have been described. In the present invention, the following elements can be further contained as required.

At Least One Element Selected from the Group Consisting of Ti: 0.5% or Less, Zr: 0.5% or Less, and V: 0.5% or Less Ti, Zr and V are elements each having a function of improving the intergranular corrosion resistance by stabilizing C and N. In view of the above, the content of Ti, Zr or V is preferably 0.02% or more. However, if the content exceeds 0.5%, the material becomes brittle. Accordingly, the content of Ti, Zr or V is limited to 0.5% or less.

These elements are effective to improve the strength at high temperature. Therefore, the (W+Ti+Zr+V+Cu) content including Cu (described below) is preferably more than 3%.

At Least One Element Selected from the Group Consisting of Ni: 2.0% or Less, Cu: 1.0% or Less, Co: 1.0% or Less, and Ca: 0.01% or Less Ni, Cu, Co and Ca are elements for improving the toughness. The Ni content is 2.0% or less, the Cu content is 1.0% or less, the Co content is 1.0% or less, and the Ca content is 0.01% or less. Especially, Ca effectively prevents a nozzle clogging during continuous casting when Ti is contained in molten steel. The effect is sufficiently exhibited when the Ni content is 0.5% or more, the Cu content is 0.05% or more, preferably the Cu content is 0.3% or more, the Co content is 0.03% or more, and the Ca content is 0.0005% or more.

Al: from 0.01 to 7.0%

Al functions as a deoxidizing agent, and forms fine scales on a surface of a weld zone to prevent absorption of oxygen and nitrogen during welding, resulting in improved toughness of the weld zone. Also, Al is an element for improving the salt corrosion resistance at high temperature. However, when the Al content is less than 0.01%, the effect is not well exerted. On the other hand, the Al content exceeds 7.0%, the material becomes significantly brittle. Therefore, the Al content is limited to 0.01 to 7.0%, and more preferably from 0.5% to 7.0%.

At Least One Element Selected from B: 0.01% or Less, and Mg: 0.01% or Less

Both B and Mg effectively improve cold-work embrittlemet. However, if each content exceeds 0.01%, the strength at room temperature is increased, and ductility is degraded. Therefore, each content is limited to less than 0.01%. More preferably, the B content is 0.0003% or more, and the Mg content is 0.0003% or more.

REM: 0.1% or Less

REM effectively improve the oxidation resistance. The REM content is 0.1% or less, and more preferably 0.002% or more. In the present invention, REM refers to Lanthanides and Y.

The method of producing the steel will be described. The method is not especially limited, and any method of producing conventional ferritic stainless steel can be applied.

For example, molten steel having a predetermined composition within the range of the present invention is refined using a smelting furnace, for example, a converter and an electric furnace, or further using ladle refining, vacuum refining, etc., and then, is made into a slab by a continuous casting method or an ingot-making method. The slab is hot rolled, and, if required, may be annealed and pickled. A cold rolled and annealed sheet is preferably produced by performing the process of cold rolling, final annealing, and pickling in that order.

More preferably, specific conditions are used in the hot and cold rolling process. Upon steel making, the molten steel containing the essential and added components is refined using the converter or the electric furnace, and is secondary refined by a VOD method. The refined molten steel can be a steel material in accordance with the known production methods. In view of the productivity and quality, the continuous casting method is preferable. The resulting steel material is heated to, for example, 1000 to 1250° C., and is hot rolled to provide a hot rolled sheet with a desired thickness. Of course, the steel material may have any form other than a sheet. The hot rolled sheet is annealed in a batch type furnace at 600 to 800° C., or in continuous annealing process at 900 to 1100° C., as required, and then descaled by pickling etc, to provide a descaled hot rolled sheet product. The hot rolled sheet may be shotblasted to remove scale before pickling.

The thus-obtained hot rolled and annealed sheet is cold rolled to provide a cold rolled sheet. The cold rolling may be performed two or more times including the intermediate annealing during the production. A total reduction in the cold rolling performed once, or two or more times is 60% or more, and preferably 70% or more. The cold rolled sheet is annealed at 950 to 1150° C., preferably annealed in continuous annealing process (final) at 980 to 1120° C., and then pickled to provide a cold rolled and annealed sheet. Depending on the application, light rolling (such as skin pass rolling) may be performed after the cold rolling and annealing to adjust the shape and quality of the steel sheet.

The resultant hot rolled sheet product, or the cold rolled sheet product can be formed depending on the application to form exhaust pipes of automobiles and motorcycles, outer casings for catalysts, exhaust ducts in thermal power plants, or fuel cells (for example, separators, interconnectors, and reformers). Any welding method can be applied to weld the members. For example, there are conventional arc welding methods using MIG (Metal Inert Gas), MAG (Metal Active Gas), and TIG (Tungsten Inert Gas), resistance welding methods including spot welding and seam welding, high frequency resistance welding methods such as electric resistance welding, and high frequency induction welding methods.

EXAMPLE 1

Fifty kilograms of each steel ingot having a composition shown in Table 1 was prepared. The steel ingot was heated to 1100° C., and thereafter, was hot rolled so as to produce a hot rolled sheet having a thickness of 5 mm. The resulting hot rolled sheet was subjected to hot rolled sheet annealing (annealing temperature: 1000° C.), pickling, cold rolling (a cold rolling reduction: 60%), final annealing (annealing temperature: 1000° C.), and pickling in that order, to produce a cold rolled and annealed sheet having a thickness of 2 mm.

Regarding the resulting cold rolled and annealed sheet, the high-temperature strength, the oxidation resistance at high temperature, and the salt corrosion resistance at high temperature were evaluated. The results are shown in Table 2.

Respective properties were determined as follows:

(1) High-Temperature Strength

Two tensile test pieces according to JIS No. 13B, in which the direction of tensile coincided with the direction of the rolling, were taken from each cold rolled and annealed sheet, and a tensile test was performed in accordance with JIS G 0567 under the conditions of tensile temperature: 900° C. and stain rate: 0.3%/min so as to measure the 0.2% proof stress at 900° C. A higher 0.2% proof stress at 900° C. is preferable. When it is 20 MPa or more, and preferably 26 MPa or more, the high-temperature strength is considered to be excellent.

(2) Oxidation Resistance at High Temperature

Two test pieces each having a thickness of 2 mm, a width of 20 mm, and a length of 30 mm were taken from each cold rolled and annealed sheet, and held at 1050° C. in air for 100 hours. The weight of each test piece was measured before and after the test. The weight changes of the two test pieces were calculated and averaged. If the weight change is 10 mg/cm$^2$ or less, it can be concluded that the sheet has an excellent oxidation resistance at high temperature.

(3) Salt Corrosion Resistance at High Temperature

Two test pieces each having a thickness of 2 mm, a width of 20 mm, and a length of 30 mm were taken from each cold rolled and annealed sheet. In one cycle, the test pieces were immersed in a 5% saline for 1 hour, heated at 700° C. in air for 23 hours, and cooled for 5 minutes. The cycle was repeated ten times to measure the weight change of each test piece. An average value was determined. The smaller the weight change, the better the salt corrosion resistance at high temperature. In the present invention, when the weight change $\Delta w$ was 50 (mg/cm$^2$) or more, the salt corrosion resistance at high temperature was evaluated as E. When the weight change $\Delta w$ was $40 \leqq \Delta w < 50$ (mg/cm$^2$), the salt corrosion resistance at high temperature was evaluated as D. When the weight change $\Delta w$ was $30 \leqq \Delta w < 40$ (mg/cm$^2$), the salt corrosion resistance at high temperature was evaluated as C. When the weight change $\Delta w$ was $20 \leqq \Delta w < 30$ (mg/cm$^2$), the salt corrosion resistance at high temperature was evaluated as B. When the weight change $\Delta w$ was $\Delta w < 20$ (mg/cm$^2$), the salt corrosion resistance at high temperature was evaluated as A. If the weight change $\Delta w$ was less than 50 mg/cm$^2$, the sheet passed the test for the salt corrosion resistance at high temperature.

As is apparent from Table 2, all of our sheets had excellent oxidation resistance at high temperature, and salt corrosion resistance at high temperature as well as strength at high temperature.

The results of Comparative and Conventional Examples outside our range are as follows:

No. 1 had W and W+Mo contents outside the range of the present invention, and had poor oxidation resistance at high temperature.

No. 14, the conventional steel, Type 429, had Mo, W, and W+Mo contents outside the range of the present invention, and had poor strength at high temperature, poor oxidation resistance at high temperature, and poor salt corrosion resistance at high temperature.

No. 15 had Mo content outside the range of the present invention, and had poor oxidation resistance at high temperature, and poor salt corrosion resistance at high temperature.

No. 16 was No. 25 in Table 1 of the prior art EP 1207214 A2, had Mo+W content outside the range of the present invention, and had poor oxidation resistance at high temperature.

EXAMPLE 2

Fifty kilograms of each steel ingot having a composition shown in Table 3 was prepared. The steel ingot was heated to 1100° C., and thereafter, was hot rolled so as to produce a hot rolled sheet having a thickness of 5 mm. The resulting hot rolled sheet was subjected to hot rolled sheet annealing (annealing temperature: 1000° C.), pickling, cold rolling (a cold rolling reduction: 60%), final annealing (annealing temperature: 1000° C.), and pickling in that order, to produce a cold rolled and annealed sheet having a thickness of 2 mm.

Regarding the resulting cold rolled and annealed sheet, the oxidation resistance at high temperature, and the salt corrosion resistance at high temperature were evaluated. The results are shown in Table 4.

The high-temperature strength, the oxidation resistance at high temperature, and the salt corrosion resistance at high temperature were evaluated as in Example 1.

As is apparent from Table 4, all sheets according to the present invention had excellent oxidation resistance at high temperature and salt corrosion resistance at high temperature, as well as excellent strength at high temperature. Nos. 24, 25 and 30 to which Al was added had especially excellent salt corrosion resistance at high temperature.

The results of Comparative Examples outside the present invention are as follows:

No. 21 had W and W+Mo contents outside our range, and had poor oxidation resistance at high temperature.

No. 34 had Mo content outside our range, and had poor oxidation resistance at high temperature, and poor salt corrosion resistance at high temperature.

EXAMPLE 3

The hot rolled sheets were tested for various properties. The hot rolled sheets each having a size of 5 mm of No. 2 in Example 1 shown in Table 1 and No. 22 shown in Table 3 were annealed at 1050° C., immersed in mixed acid (15 mass percent of nitric acid+5 mass percent of hydrofluoric acid) at 60° C., and descaled to provide hot rolled and annealed sheets. The resultant hot rolled and annealed sheets were evaluated for the high-temperature strength, the oxidation resistance at high temperature, and the salt corrosion resistance at high temperature as in Example 1 except that the thickness of each test piece was 5 mm.

As a result, No. 2 shown in Table 1 and No. 22 shown in Table 3 had high-temperature strengths of 27 MPa and 30 MPa, oxidation resistances at high temperature of 7 mg/cm$^2$ and 6 mg/cm$^2$, and salt corrosion resistances at high temperature of C and D, respectively. It is confirmed that the hot rolled and annealed sheets had substantially similar properties as those of the cold rolled and annealed sheets.

INDUSTRIAL APPLICABILITY

There can be stably provided a ferritic stainless steel which has excellent, strength at high temperature, oxidation resistance at high temperature, and salt, corrosion resistance at high temperature.

Accordingly, there can be stably provided a material suitable for use in exhaust pipes of automobiles and motorcycles, outer casings for catalysts, exhaust ducts in thermal power generation plants, or fuel cells (for example, separators, interconnectors, and reformers), as well as automobile-related applications where exhaust gas temperatures exceed 900° C. due to improvements in engine performance.

TABLE 1

| NO. | Composition (mass %) C | Si | Mn | Cr | Mo | W | Mo + W | Nb | N | Others | Remarks |
|---|---|---|---|---|---|---|---|---|---|---|---|
| 1 | 0.007 | 0.81 | 0.95 | 14.1 | 1.8 | 1.11 | 2.91 | 0.49 | 0.007 | — | Comp. Ex. |
| 2 | 0.003 | 0.65 | 0.85 | 15.3 | 1.42 | 3.11 | 4.53 | 0.55 | 0.002 | — | Ex. |
| 3 | 0.002 | 0.93 | 0.86 | 15.5 | 1.98 | 3.02 | 5 | 0.54 | 0.003 | — | Ex. |
| 4 | 0.003 | 0.99 | 0.87 | 15.4 | 1.92 | 4.11 | 6.03 | 0.53 | 0.003 | — | Ex. |
| 5 | 0.008 | 0.83 | 0.96 | 14.2 | 1.93 | 3.07 | 5 | 0.51 | 0.008 | — | Ex. |
| 6 | 0.007 | 1.15 | 0.95 | 12.1 | 1.91 | 2.81 | 4.72 | 0.64 | 0.004 | Ti: 0.20, Ca: 0.003 | Ex. |
| 7 | 0.006 | 0.68 | 0.97 | 14.8 | 2.14 | 2.83 | 4.97 | 0.55 | 0.006 | Zr: 0.19 | Ex. |
| 8 | 0.008 | 0.89 | 0.99 | 15.9 | 1.51 | 2.9 | 4.41 | 0.54 | 0.004 | V: 0.17, Co: 0.11 | Ex. |
| 9 | 0.007 | 1.54 | 0.95 | 15.8 | 1.82 | 2.53 | 4.35 | 0.65 | 0.003 | Ni: 0.74, Cu: 0.14 | Ex. |
| 10 | 0.006 | 0.64 | 0.97 | 12.5 | 1.71 | 2.64 | 4.35 | 0.64 | 0.005 | Al: 0.12 | Ex. |
| 11 | 0.005 | 0.65 | 0.89 | 12.1 | 1.81 | 2.6 | 4.41 | 0.55 | 0.004 | B: 0.0009 | Ex. |
| 12 | 0.007 | 0.64 | 0.99 | 12.1 | 1.9 | 3.21 | 5.11 | 0.44 | 0.008 | Mg: 0.0033 | Ex. |
| 13 | 0.007 | 0.63 | 0.98 | 12.1 | 1.91 | 2.82 | 4.73 | 0.47 | 0.007 | REM: 0.014 | Ex. |
| 14 | 0.005 | 0.81 | 0.41 | 14.5 | — | — | — | 0.51 | 0.003 | — | Conventional (Type 429 steel) |
| 15 | 0.009 | 0.61 | 0.91 | 14.5 | 0.93 | 3.5 | 4.43 | 0.51 | 0.008 | — | Comp. Ex. |
| 16 | 0.004 | 0.33 | 1.78 | 12.7 | 1.61 | 2.59 | 4.2 | 0.49 | 0.005 | Ni: 0.55 | Comp. Ex. (corresponds to No. 25, Table 1, EP1207214 A2) |

TABLE 2

| No. | High temperature oxidation resistance (mg/cm2) | High temperature salt corrosion resistance | High temperature strength (MPa) | Remarks |
|---|---|---|---|---|
| 1 | 31* | C | 23 | Comp. Ex. |
| 2 | 7 | C | 28 | Ex. |
| 3 | 4 | A | 30 | Ex. |
| 4 | 3 | A | 33 | Ex. |
| 5 | 4 | C | 30 | Ex. |
| 6 | 5 | B | 32 | Ex. |
| 7 | 4 | C | 31 | Ex. |
| 8 | 4 | C | 27 | Ex. |
| 9 | 5 | B | 26 | Ex. |

TABLE 2-continued

| No. | High temperature oxidation resistance (mg/cm2) | High temperature salt corrosion resistance | High temperature strength (MPa) | Remarks |
|---|---|---|---|---|
| 10 | 6 | C | 26 | Ex. |
| 11 | 6 | C | 27 | Ex. |
| 12 | 5 | C | 32 | Ex. |
| 13 | 1 | C | 30 | Ex. |
| 14 | 150* | E | 15 | Conventional |
| 15 | 25* | E | 24 | Comp. Ex. |
| 16 | 80* | D | 25 | Comp. Ex. |

*Extra ordinary oxidation

TABLE 3

| NO. | Composition (mass %) C | Si | Mn | Cr | Mo | W | Mo + W | Nb | N | Others | Remarks |
|---|---|---|---|---|---|---|---|---|---|---|---|
| 21 | 0.005 | 0.08 | 0.55 | 17.8 | 1.81 | 1.52 | 3.33 | 0.51 | 0.007 | — | Comp. Ex. |
| 22 | 0.004 | 0.09 | 0.95 | 18.5 | 1.91 | 3.12 | 5.03 | 0.5 | 0.008 | — | Ex. |
| 23 | 0.003 | 0.05 | 0.35 | 16.5 | 1.93 | 2.81 | 4.74 | 0.45 | 0.003 | Al: 0.58 | Ex. |
| 24 | 0.003 | 0.04 | 0.38 | 16.4 | 1.92 | 2.81 | 4.73 | 0.41 | 0.004 | Al: 2.21 | Ex. |
| 25 | 0.004 | 0.09 | 0.42 | 16.6 | 1.91 | 2.65 | 4.56 | 0.37 | 0.004 | Al: 4.85 | Ex. |
| 26 | 0.006 | 0.08 | 0.85 | 18.5 | 1.81 | 2.91 | 4.72 | 0.49 | 0.005 | Ti: 0.25, Ca: 0.002 | Ex. |
| 27 | 0.005 | 0.68 | 1.2 | 18.2 | 2.22 | 3.12 | 5.34 | 0.5 | 0.006 | Zr: 0.12 | Ex. |
| 28 | 0.008 | 0.09 | 0.55 | 18.6 | 2.11 | 2.91 | 5.02 | 0.54 | 0.007 | V: 0.11, Co: 0.06 | Ex. |
| 29 | 0.005 | 0.05 | 0.57 | 18.5 | 3.1 | 3.13 | 6.23 | 0.65 | 0.008 | Ni: 0.25, Cu: 0.35 | Ex. |
| 30 | 0.006 | 0.09 | 0.12 | 16.5 | 2.12 | 3.11 | 5.23 | 0.48 | 0.011 | Ni: 1.25, Al: 1.5 | Ex. |
| 31 | 0.007 | 0.04 | 0.55 | 20.4 | 1.81 | 3.1 | 4.91 | 0.42 | 0.011 | B: 0.0008 | Ex. |
| 32 | 0.009 | 0.08 | 0.57 | 18.8 | 1.21 | 3.52 | 4.73 | 0.45 | 0.009 | Mg: 0.0012 | Ex. |
| 33 | 0.004 | 0.04 | 0.21 | 16.8 | 1.82 | 3.11 | 4.93 | 0.48 | 0.005 | Ca: 0.003, REM: 0.045 | Ex. |
| 34 | 0.004 | 0.02 | 0.41 | 16.2 | 0.95 | 3.55 | 4.5 | 0.49 | 0.005 | — | Comp. Ex. |
| 35 | 0.003 | 0.53 | 1.21 | 15.8 | 1.83 | 3.01 | 4.84 | 0.55 | 0.005 | Ti: 0.12 | Ex. |

TABLE 4

| No. | High temperature oxidation resistance (mg/cm2) | High temperature salt corrosion resistance | High temperature strength (MPa) | Remarks |
|---|---|---|---|---|
| 21 | 24* | D | 22 | Comp. Ex. |
| 22 | 5 | D | 30 | Ex. |
| 23 | 2 | D | 30 | Ex. |
| 24 | 1 | C | 28 | Ex. |
| 25 | 1 | B | 30 | Ex. |
| 26 | 3 | D | 27 | Ex. |
| 27 | 1 | D | 27 | Ex. |
| 28 | 2 | D | 30 | Ex. |
| 29 | 5 | D | 32 | Ex. |
| 30 | 2 | C | 30 | Ex. |
| 31 | 4 | D | 29 | Ex. |
| 32 | 4 | D | 28 | Ex. |
| 33 | 2 | D | 29 | Ex. |
| 34 | 25* | E | 25 | Comp. Ex. |
| 35 | 5 | D | 29 | Ex. |

*Extra ordinary oxidation

The invention claimed is:

1. A ferritic stainless steel having a composition, on a % by mass basis, comprising:

C: 0.02% or less;

Si: 2.0% or less;

Mn: 2.0% or less;

Cr: from 12.0 to 20.0%;

Mo: from 1.0 to 5.0%;

W: 3.5% to 5.0%;

wherein the total content of Mo and W: (Mo+W)≧4.5%,

Nb: 0.4 to 0.7%,

N: 0.02% or less,

V in an amount up to 0.5% and

Fe and inevitable impurities as residual, and having a proof stress at 900° C. of 20 MPa or more.

2. The ferritic stainless steel according to claim 1, wherein the content of Si is from 0.5 to 2.0%, and the content of Cr is from 12.0 to 16.0%.

3. The ferritic stainless steel according to claim 2, further comprising, on a % by mass basis, at least one element selected from the group consisting of Ti: 0.5% or less and Zr: 0.5% or less.

4. The ferritic stainless steel having excellent strength at high temperature, oxidation resistance at high temperature, and salt corrosion resistance at high temperature according to claim 2, further comprising, on a % by mass basis, at least one element selected from the group consisting of Ni: 2.0% or less, Cu: 1.0% or less, Co: 1.0% or less, and Ca: 0.01% or less.

5. The ferritic stainless steel having excellent strength at high temperature, oxidation resistance at high temperature, and salt corrosion resistance at high temperature according to claim 2, further comprising, on a % by mass basis, Al: from 0.01 to 7.0%.

6. The ferritic stainless steel according to claim 2, further comprising, on a % by mass basis, at least one element selected from the group consisting of B: 0.01% or less, and Mg: 0.01% or less.

7. The ferritic stainless steel according to claim 2, further comprising, on a % by mass basis, REM: 0.1% or less.

8. The ferritic stainless steel according to claim 1, wherein the content of Cr is more than 16.0% and 20.0% or less.

9. The ferritic stainless steel according to claim 8, further comprising, on a % by mass basis, at least one element selected from the group consisting of Ti: 0.5% or less and Zr: 0.5% or less.

10. The ferritic stainless steel according to claim 8, further comprising, on a % by mass basis, at least one element selected from the group consisting of Ni: 2.0% or less, Cu: 1.0% or less, Co: 1.0% or less, and Ca: 0.01% or less.

11. The ferritic stainless steel according to claim 8, further comprising, on a % by mass basis, Al: from 0.01 to 7.0% or less.

12. The ferritic stainless steel according to claim 8, further comprising, on a % by mass basis, at least one element selected from the group consisting of B: 0.01% or less, and Mg: 0.01% or less.

13. The ferritic stainless steel according to claim 8, further comprising, on a % by mass basis, comprising REM: 0.1% or less.

14. The ferritic stainless steel sheet according to claim 1, which is a hot rolled steel sheet.

15. The ferritic stainless steel sheet according to claim 1, which is a cold rolled steel sheet.

16. A method of producing a hot rolled ferritic stainless steel sheet, comprising the steps of:

adjusting the composition of molten steel comprising:

C: 0.02% or less;

Si: 2.0% or less;

Mn: 2.0% or less;

Cr: from 12.0 to 20.0%;

Mo: from 1.0 to 5.0%;

W: 3.5% to 5.0%;

wherein the total content of Mo and W: (Mo+W)≧4.5%,

Nb: 0.4 to 0.7%,

N: 0.02% or less,

V in an amount up to 0.5% and

Fe and inevitable impurities as residual to provide a steel slab, hot rolling the slab, and continuous annealing at 950-1150° C. and pickling the hot rolled sheet, as required.

17. The method of producing the hot rolled ferritic stainless steel sheet according to claim 16, wherein the molten steel comprises, on a % by mass basis, Si: from 0.5 to 2.0%, and Cr: from 12.0 to 16.0%.

18. The method of producing the hot rolled ferritic stainless steel sheet according to claim 17, wherein the molten steel further comprises, on a % by mass basis, at least one element selected from the group consisting of Ti: 0.5% or less and Zr: 0.5% or less.

19. The method of producing the hot rolled ferritic stainless steel sheet according to claim 17, wherein the molten steel further comprises, on a % by mass basis, at least one element selected from the group consisting of Ni: 2.0% or less, Cu: 1.0% or less, Co: 1.0% or less, and Ca: 0.01% or less.

20. The method of producing the hot rolled ferritic stainless steel sheet according to claim 17, wherein the molten steel further comprises, on a % by mass basis, Al: 0.01 to 7.0%.

21. The method of producing the hot rolled ferritic stainless steel sheet according claim 17, wherein the molten steel further comprises, on a % by mass basis, at least one element selected from the group consisting of B: 0.01% or less, and Mg: 0.01% or less.

22. The method of producing the hot rolled ferritic stainless steel sheet according to claim 17, wherein the molten steel further comprises, on a % by mass basis, REM: 0.1% or less.

23. The method of producing the hot rolled ferritic stainless steel sheet according to claim 16, wherein the molten steel further comprises, on a % by mass basis, Cr: more than 16.0% and 20.0% or less.

24. The method of producing the hot rolled ferritic stainless steel sheet according to claim 23, the molten steel further comprises, on a % by mass basis, at least one element selected from the group consisting of Ti: 0.5% or less and Zr: 0.5% or less.

25. The method of producing the hot rolled ferritic stainless steel sheet according to claim 23, wherein the molten steel further comprises, on a % by mass basis, at least one element selected from the group consisting of Ni: 2.0% or less, Cu: 1.0% or less, Co: 1.0% or less, and Ca: 0.01% or less.

26. The method of producing the hot rolled ferritic stainless steel sheet according to claim 23, wherein the molten steel further comprises, on a % by mass basis, Al: from 0.01 to 7.0%.

27. The method of producing the hot rolled ferritic stainless steel sheet according to claim 23, wherein the molten steel further comprises, on a % by mass basis, at least one element selected from the group consisting of B: 0.01% or less, and Mg: 0.01% or less.

28. The method of producing the hot rolled ferritic stainless steel sheet according to claim 23, wherein the molten steel further comprises, on a % by mass basis, REM: 0.1% or less.

29. The method of producing the cold rolled ferritic stainless steel sheet according to claim 16, further comprising the steps of cold rolling, annealing and pickling the hot rolled steel sheet.

* * * * *